US007854619B2

(12) United States Patent
Takahashi et al.

(10) Patent No.: US 7,854,619 B2
(45) Date of Patent: Dec. 21, 2010

(54) LEVER-FITTING CONNECTOR

(75) Inventors: Toshiharu Takahashi, Makinohara (JP); Kenji Kajikawa, Makinohara (JP)

(73) Assignee: Yazaki Corporation, Tokyo (JP)

( * ) Notice: Subject to any disclaimer, the term of this patent is extended or adjusted under 35 U.S.C. 154(b) by 129 days.

(21) Appl. No.: 12/213,782

(22) Filed: Jun. 24, 2008

(65) Prior Publication Data

US 2009/0269966 A1 Oct. 29, 2009

(30) Foreign Application Priority Data

Jun. 29, 2007 (JP) ..... P2007-171582

(51) Int. Cl.
*H01R 13/62* (2006.01)

(52) U.S. Cl. ..... 439/157

(58) Field of Classification Search ..... 439/157, 439/152, 159, 160, 372, 351, 352, 358
See application file for complete search history.

(56) References Cited

U.S. PATENT DOCUMENTS 5,230,635 A * 7/1993 Takenouchi et al. ..... 439/157
5,344,194 A * 9/1994 Hatagishi et al. ..... 285/26
5,474,462 A * 12/1995 Yamanashi ..... 439/157
5,482,394 A * 1/1996 Shinchi et al. ..... 403/325
5,551,885 A * 9/1996 Yamanashi et al. ..... 439/157
5,711,682 A * 1/1998 Maejima ..... 439/157
6,254,409 B1 7/2001 Okabe et al. ..... 439/157
6,755,674 B2 * 6/2004 Fujii et al. ..... 439/157
7,537,469 B2 * 5/2009 Takahashi et al. ..... 439/157
2003/0199185 A1 * 10/2003 Fujii et al. ..... 439/157
2007/0032107 A1 2/2007 Matsubara et al. ..... 439/157
2007/0167088 A1 * 7/2007 Ohtaka et al. ..... 439/850
2009/0023316 A1 * 1/2009 Takahashi et al. ..... 439/157

FOREIGN PATENT DOCUMENTS

GB 2 322 979 A 9/1998
JP 2005-122942 5/2005

* cited by examiner

*Primary Examiner*—T C Patel
*Assistant Examiner*—Harshad C Patel
(74) *Attorney, Agent, or Firm*—Morgan, Lewis & Bockius LLP

(57) ABSTRACT

A lever-fitting connector includes: a first connector; a second connector having a retaining portion; and a rotatable lever which engages the first connector with the second connector. The rotatable lever includes a retaining arm for provisionally retaining the lever with the second connector to abut on the retaining portion. The retaining arm extends to form a slit between the retaining arm and an edge of the rotatable lever. A width of the slit is smaller than an elastic range of the retaining arm at which the retaining arm bends toward the edge.

3 Claims, 15 Drawing Sheets

LEVER-FITTING CONNECTOR

BACKGROUND OF THE INVENTION

1. Technical Field

This invention relates to a lever-fitting connector in which a male connector can be easily fitted to a female connector by pivotally moving a lever mounted on the male connector, and more particularly to a lever-fitting connector in which provisionally-retaining arms are formed at the lever so as to hold the lever in a provisionally-retaining position.

2. Background Art

One known conventional lever-fitting connector having provisionally-retaining arms formed at a lever is disclosed in JP-A-2005-122942. The conventional lever-fitting connector disclosed in JP-A-2005-122942 will be described with reference to the drawings.

FIG. 11A is a perspective view of the conventional lever-fitting connector, and FIG. 11B is a side-elevational view thereof. FIG. 12A is a perspective view showing a condition in which a male connector and a female connector are fitted together in a provisionally-retaining position, FIG. 12B is an enlarged perspective view showing the relation between the provisionally-retaining arm and a provisional retainment cancellation projection, and FIG. 12C is an enlarged perspective view showing the relation between a slide induction projection and a lever sliding-purpose abutment projection. FIG. 13 is a side-elevational view showing the condition in which the male connector and the female connector are fitted together in the provisionally-retaining position. FIG. 14 is a perspective view showing a condition in which the male connector and the female connector are completely fitted together.

In FIGS. 11A, 11B and 11B, the lever-fitting connector 1 includes the female connector 3 having a fitting hood portion 2, the male connector 5 having a male connector body 4 for fitting to the fitting hood portion 2, the lever 6 which is pivotally mounted on the male connector 5 and can be pivotally moved so as to bring the male connector 5 into and out of fitting engagement with the female connector 3, and a seal member (not shown) provided between the male connector 5 and the fitting hood portion 2 so as to form a seal therebetween.

A waterproof hood portion 8 is provided at an outer periphery of the male connector body 4, and when the male connector body 4 is fitted to the fitting hood portion 2, this waterproof hood portion 8 covers the fitting hood portion 2. The lever 6 is pivotally mounted on an outer periphery of this waterproof hood portion 8. The lever 6 has fulcrum projections 9 projecting through the waterproof hood portion 8 toward the male connector body 4. Fulcrum retaining portions 10 for retaining the fulcrum projections 9 are provided at the fitting hood portion 2. The male connector body 4 includes two male connector bodies, that is, a larger male connector body 4*a* and a smaller male connector body 4*b*. Waterproof hood portions 8*a* and 8*b* forming the waterproof hood 8 are provided respectively at the peripheries of the male connector bodies 4*a* and 4*b*.

The waterproof hood portions 8*a* and 8*b* are interconnected by an interconnecting projection 31. Pivot shafts 36 are formed on the waterproof hood portion 8*b*. The pivot shafts 36 are adapted to be inserted respectively in pivot holes 42 of the lever 6. A lever distal end portion-holding wall 37 of a generally L-shape is provided at the waterproof hood portion 8*b*, and extends to a wire lead-out surface 25. A lever holding portion 43 is provided at the outer side of the waterproof hood portion 8*a*. Provisionally-retaining step portions 38 are provided at corner portions of the lever holding portion 43. A lock arm 46 of the lever 6 is adapted to be inserted in the lever holding portion 43. The provisionally-retaining arm 44 of the lever 6 are adapted to abut respectively against the provisionally-retaining step portions 38. When the provisionally-retaining arms 44 abut respectively against the step portions 38, the lever 6 is held in the provisionally-retaining position relative to the male connector 5.

The fitting hood portion 2 is formed on and projects from a female connector housing 11. The fitting hood portion 2 includes two hood portions, that is, a larger hood portion 2*a* and a smaller hood portion 2*b*. Fulcrum retaining portions 10 are formed respectively on upper and lower surfaces 12*a* of the hood portion 2*b*. The fulcrum retaining portion 10 includes an insertion-purpose fulcrum retaining projection 13, and a disengagement-purpose fulcrum retaining projection 14. The insertion-purpose fulcrum retaining projection 13 includes a parallel surface 13*a*, and a retaining slanting surface 13*b*.

Lever sliding-purpose abutment projections 17 each for guiding the corresponding slide induction projection 16 of the lever 6 in abutting relation thereto are formed respectively on upper and lower surfaces 15*a* and 15*b* of the hood portion 2*a*. The lever sliding-purpose abutment projection 17 includes a straight portion 17*a*, and a slanting portion 17*b*, and a pick-up portion 17*c* is formed at an open end of the slanting portion 17*b*. Further, retainment cancellation projections 18 are formed respectively on the upper and lower surfaces 15*a* and 15*b* of the hood portion 2*a*. The retainment cancellation projection 18 includes a pick-up surface 18*a*, and a holding surface 18*b*. A lock projection 21 is formed on an outer surface 19 of the hood portion 2*a*.

The lever 6 includes a pair of lever side plates 39, and an interconnection operating portion 40, and is formed into a generally U-shape. Retaining pieces 41 are provided respectively at the lever side plates 39. The long-circular pivot hole 42 is formed in an intermediate portion of each lever side plate 39. The pivot shafts 36 are inserted respectively in the pivot holes 42, so that the lever 6 is pivotally supported on the made connector body 4. The slide induction projections 16 are formed respectively on inner surfaces of the pair of lever side plates 39. Each slide induction projection 16 is adapted to be guided by the corresponding lever sliding-purpose abutment projection 17 in abutting relation thereto.

The provisionally-retaining arms 44 of an elasticity are formed respectively at the pair of lever side plates 39. When the lever 6 is pivotally supported on the male connector body 4*b*, the provisionally-retaining arms 44 abut respectively against the provisionally-retaining step portions 38 of the waterproof hood portion 8*a*. The provisionally-retaining arms 44 can hold the lever 6 in the provisionally-retaining position relative to the male connector 5. The interconnection operating portion 40 includes an interconnecting plate 45, the lock arm 46, and operating surfaces 47. The lock arm 46 has a lock frame portion 48. This lock frame portion 48 is adapted to be engaged with the lock projection 21 of the hood portion 2*a*.

Next, the procedure of the fitting operation of the lever-fitting connector 1 of the above construction will be described.

As shown in FIGS. 11A, 11B and 11B, the male connector 5 and the female connector 3 are opposed to each other such that the hood portions 2*a* and 2*b* are opposed respectively to the male connector bodies 4*a* and 4*b*. In this condition, the lever 6 is held in the provisionally-retaining position relative to the male connector 5. Namely, the provisionally-retaining arms 44 of the lever 6 abut respectively against the provisionally-retaining step portions 38 of the waterproof hood portion 8*a*.

Then, the male connector bodies 4*a* and 4*b* are provisionally fitted into the hood portions 2*a* and 2*b* of the male connector bodies 4*a* and 4*b* as shown in FIGS. 12A and 13. In this condition, the lever 6 is held in the provisionally-retaining position relative to the male connector 5, and each provisional retainment cancellation projection 18 bends the provisionally-retaining arm 44 outwardly, thereby cancelling the provisionally-retained condition of the lever 6 as shown in FIG. 12B. At this time, each slide induction projection 16 abuts against the end portion (defining a starting point) of the lever sliding-purpose abutment projection 17.

In this condition, when a force F is applied to the interconnection operating portion 40 of the lever 6, each slide induction projection 16 of the lever 6 is guided by the lever sliding-purpose abutment projection 17, and the lever 6 is guided in a direction intersecting the fitting direction, that is, in the longitudinal direction of the male connector 5, and is slid toward the male connector body 4*b*. Each fulcrum projection 9 is brought into engagement with the insertion-purpose fulcrum retaining projection 13, and the lever 6 is pivotally moved or turned on the insertion-purpose fulcrum retaining projections 13 serving as a fulcrum. By this turning operation, a turning force is applied to the male connector bodies 4*a* and 4*b*, and the male connector bodies 4*a* and 4*b* are inserted respectively into the hood portions 2*a* and 2*b*.

Then, when the lever 6 is further pivotally moved, the lock frame portion 48 of the lever 6 is engaged with the lock projection 21 of the hood portion 2*a*, and the male connector bodies 4*a* and 4*b* are completely inserted and fitted in the hood portions 2*a* and 2*b*, respectively, thus completing the fitting connection between the male connector 5 and the female connector 3 as shown in FIG. 14.

In the above conventional lever-fitting connector 1, the following problem is encountered in the condition before the male connector bodies 4*a* and 4*b* are provisionally fitted in the respective hood portions 2*a* and 2*b*, that is, in the condition in which the lever 6 is held in the provisionally-retaining position relative to the male connector 5. Namely, in the condition in which the lever 6 is held in the provisionally-retaining position before the fitting operation, when an unnecessary force is applied to the interconnection operating portion 40 of the lever 6, this unnecessary force acts on the provisionally-retaining arms 44 of the lever 6 held against the provisionally-retaining step portion 38, so that the provisionally-retaining arms 44 may be damaged or broken.

This is due to the fact that each lever side plate 39 is formed such that a relatively large space is formed immediately adjacent to the provisionally-retaining arm 44 (the provisionally-retaining arm 44 is provided such that the relatively large space is formed immediately adjacent thereto). When the provisionally-retaining arm 44 is excessively elastically deformed or bent beyond its elastic range, it will be damaged or broken.

When the above unnecessary force acts on the provisionally-retaining arm 44, the provisionally-retaining arm 44 is elastically deformed in a direction different from the direction of elastic deformation (outward bending) thereof by the provisional retainment cancellation projection 18, and as a result of this elastic deformation in the above different direction, a crack develops in the proximal end portion of the provisionally-retaining arm 44, thus damaging the provisionally-retaining arm 44.

It may be proposed to increase the width of the provisionally-retaining arm 44 so as to suppress the elastic deformation thereof in the above different direction. In this case, however, the increased width of the provisionally-retaining arm 44 increases the rigidity thereof, so that the elastic deformation (outward bending) of the provisionally-retaining arm 44 by the provisional retainment cancellation projection 18 will be affected.

SUMMARY OF THE INVENTION

This invention has been made in view of the above circumstances, and an object of the invention is to provide a lever-fitting connector in which breakage of provisionally-retaining arms is prevented, and a provisionally-retained condition of the lever can be stabilized.

The above object has been achieved by a lever-fitting connector, including:

a first connector;

a second connector having a retaining portion; and a rotatable lever which engages the first connector with the second connector, wherein the rotatable lever includes a retaining arm for provisionally retaining the lever with the second connector to abut on the retaining portion;

wherein the retaining arm extends to form a slit between the retaining arm and an edge of the rotatable lever; and wherein a width of the slit is smaller than an elastic range of the retaining arm at which the retaining arm bends toward the edge.

Preferably, a width of the slit between the edge and a head of the retaining arm is smaller than a width of the slit between the edge of the rotatable lever and a root of the retaining arm.

Preferably, a convex portion is formed on at least one of the retaining arm and the edge of the rotatable lever to narrow the width of the slit.

In the present invention having the above features, in the condition in which the lever is held in the provisionally-retaining position relative to the male connection, even when an unnecessary force is applied to the lever, and acts on the provisionally-retaining arms, each provisionally-retaining arm is slightly elastically deformed, and is brought into abutting engagement with the edge of the lever side plate, and is prevented from being further elastically deformed.

According to the above configurations, there is achieved an advantage that breakage or damage of the provisionally-retaining arms can be prevented. Therefore, there is also achieved an advantage that the provisionally-retained condition of the lever can be stabilized.

According to the above configurations, there is achieved an advantage that the amount of elastic deformation of the provisionally-retaining arms in such a direction as to invite the breakage of these arms can be further reduced.

BRIEF DESCRIPTION OF THE DRAWINGS

The above objects and advantages of the present invention will become more apparent by describing in detail preferred exemplary embodiments thereof with reference to the accompanying drawings, wherein like reference numerals designate like or corresponding parts throughout the several views, and wherein.

DETAILED DESCRIPTION OF THE PREFERRED EMBODIMENTS

Figure 1:
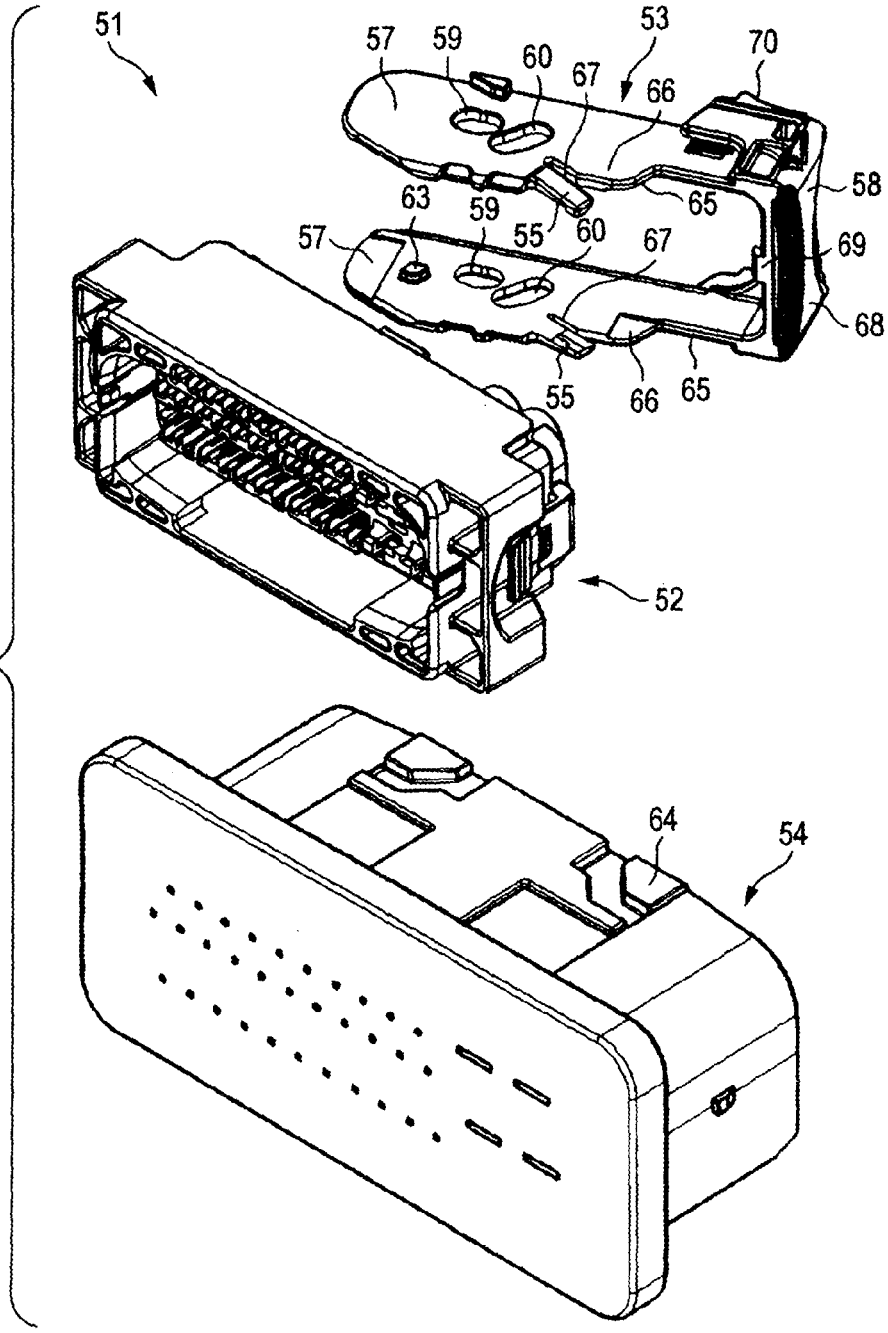
FIG. 1 is an exploded perspective view of one preferred embodiment of a lever-fitting connector of the present invention.
Figure 2:
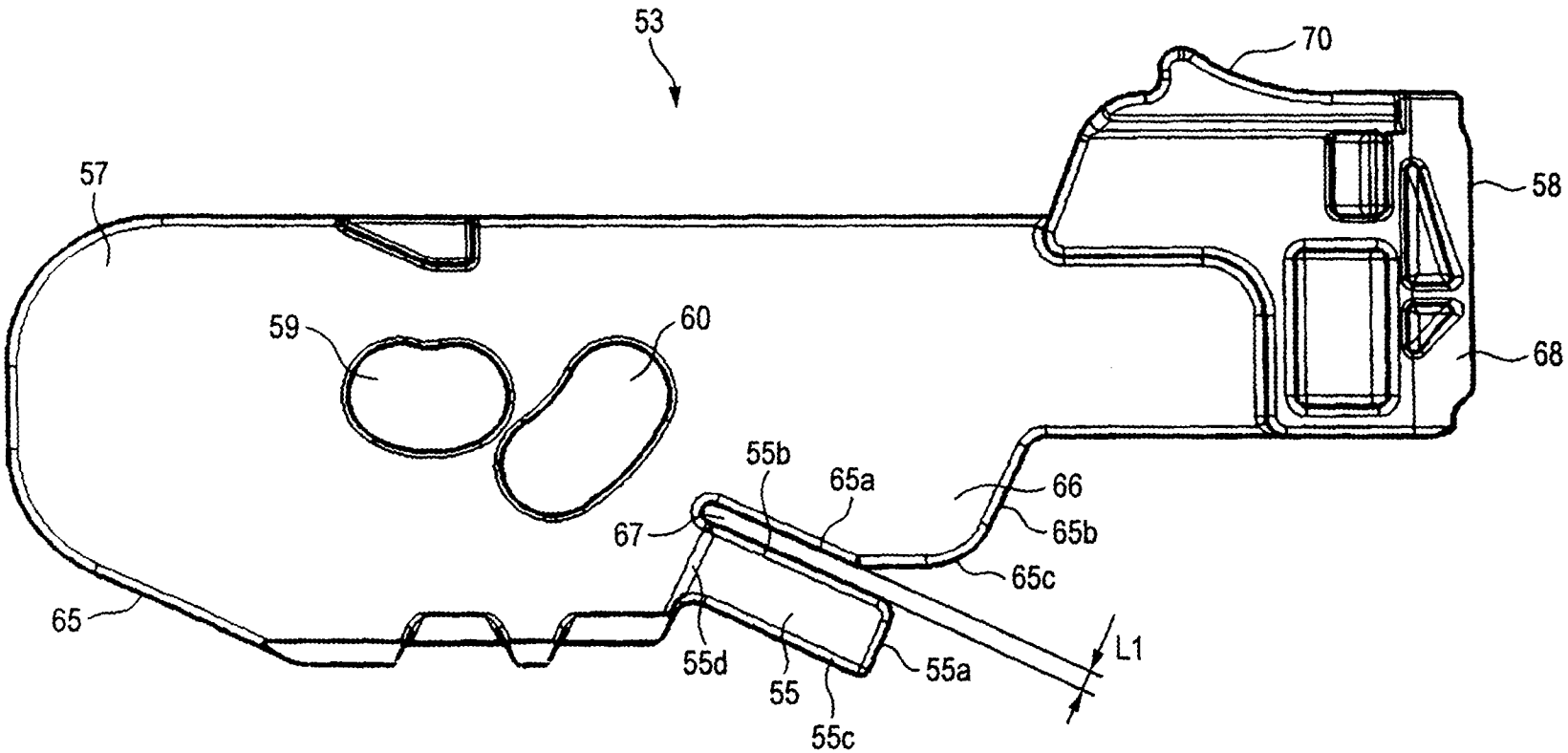
FIG. 2 is a side-elevational view of a lever.
Figure 4:
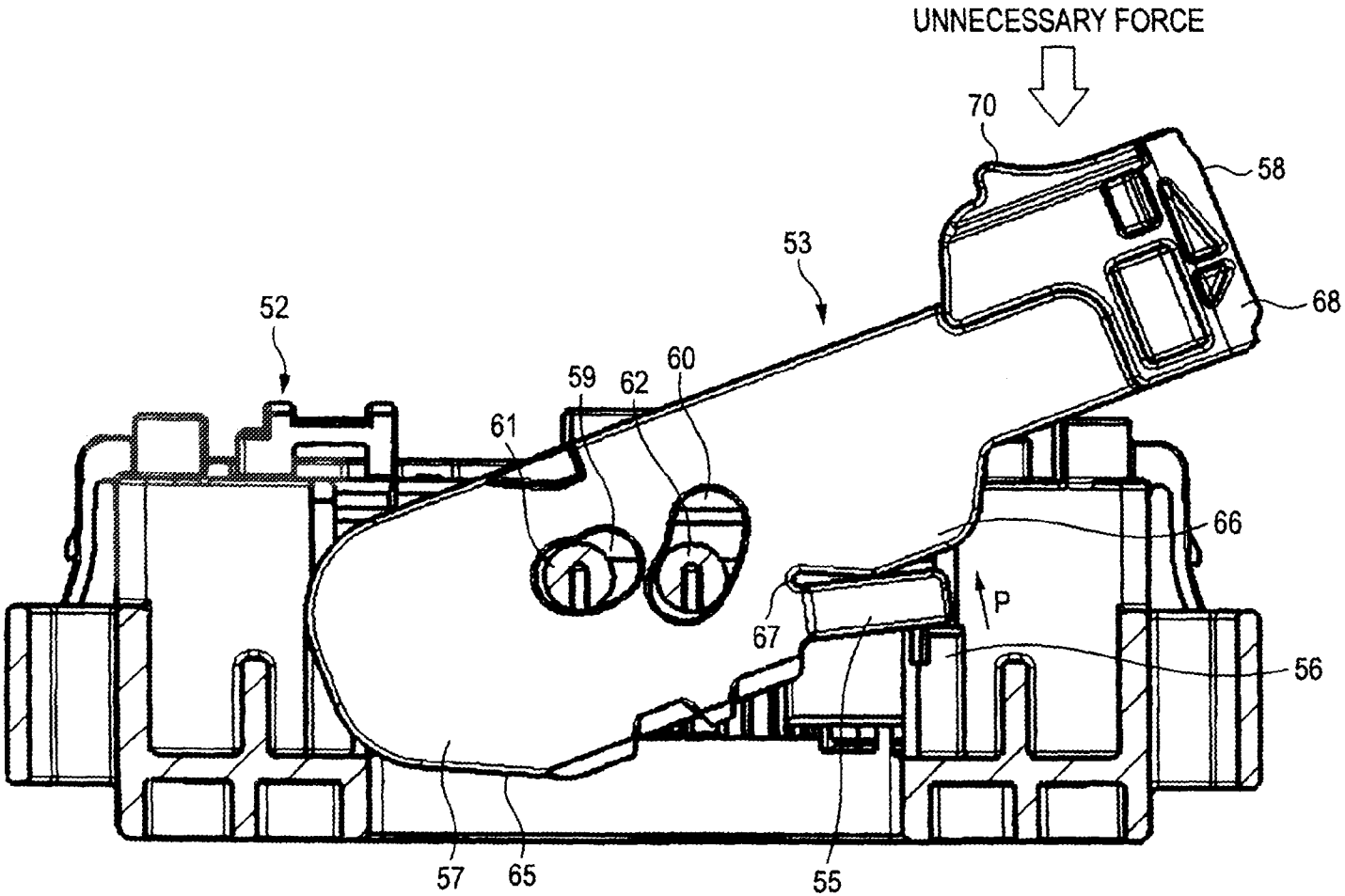
FIG. 4 is a view showing a condition in which a provisionally-retaining arm is elastically deformed.
Figure 5:
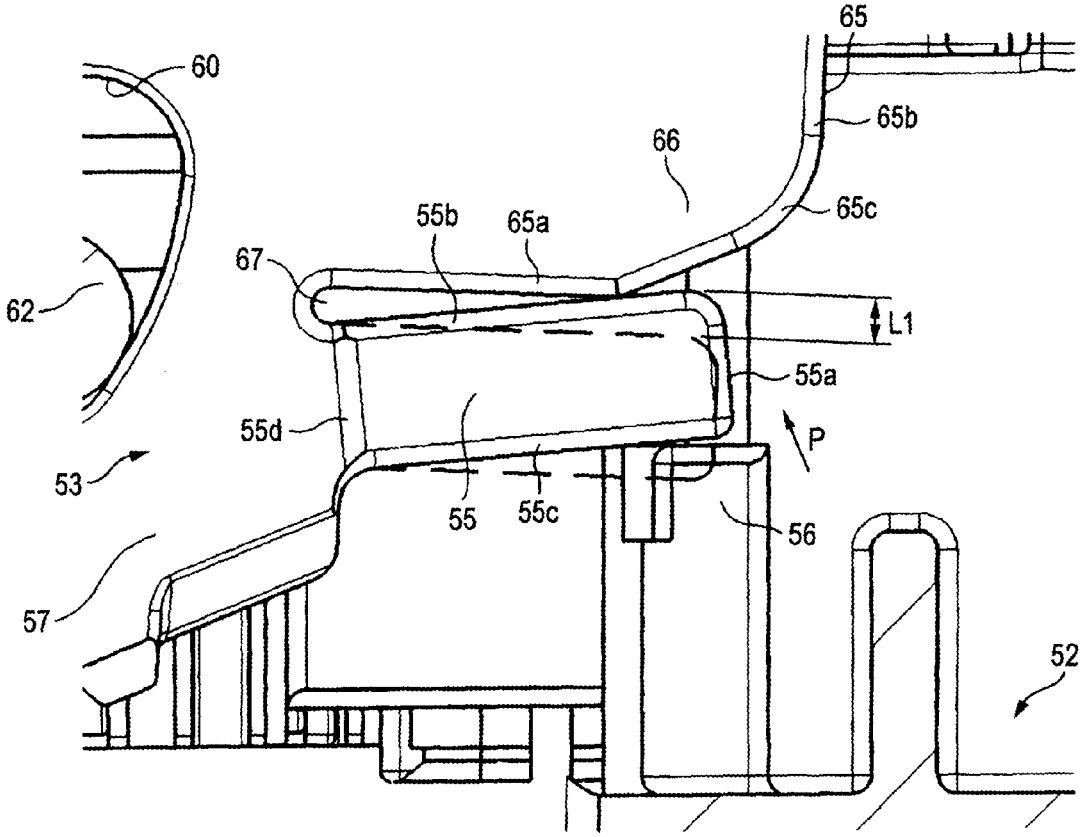
FIG. 5 is an enlarged view of an important portion of FIG. 4.

The present invention will now be described with reference to the drawings. FIG. 1 is an exploded perspective view of one preferred embodiment (first embodiment) of a lever-fitting connector of the invention. FIG. 2 is a side-elevational view of a lever, FIG. 3 is a view showing a condition in which the lever is held in a provisionally-retaining position relative to a male connector, FIG. 4 is a view showing a condition in which a provisionally-retaining arm is elastically deformed, and FIG. 5 is an enlarged view of an important portion of FIG. 4.

In FIG. 1, the lever-fitting connector 51 of the invention includes the male connector 52, the lever 53 pivotally mounted on the male connector 52, and a female connector 54 which is fitted to the male connector 52 to be electrically connected thereto by pivotally moving the lever 53 (In the case where the connector 51 is formed into a waterproof type, the connector 51 further includes a seal member.). The lever-fitting connector 51 has such a structure that when the pair of provisionally-retaining arms 55 formed at the lever 53 abut respectively against provisionally-retaining step portions 56 (see FIG. 3) of the male connector 52, the lever 53 is held in the provisionally-retaining position relative to the male connector 52.

The function of the lever 53 and the operation for fitting the male connector 52 and the female connector 54 together are basically the same as those of the conventional lever-fitting connector 1 (see FIGS. 11 to 14), and therefore description thereof will be omitted here. The present invention is characterized by the provisionally-retaining arms 55 formed at the lever 53 and also by the structure around each provisionally-retaining arm 53, and therefore these features will hereafter be described with reference to the drawings.

Figure 3:
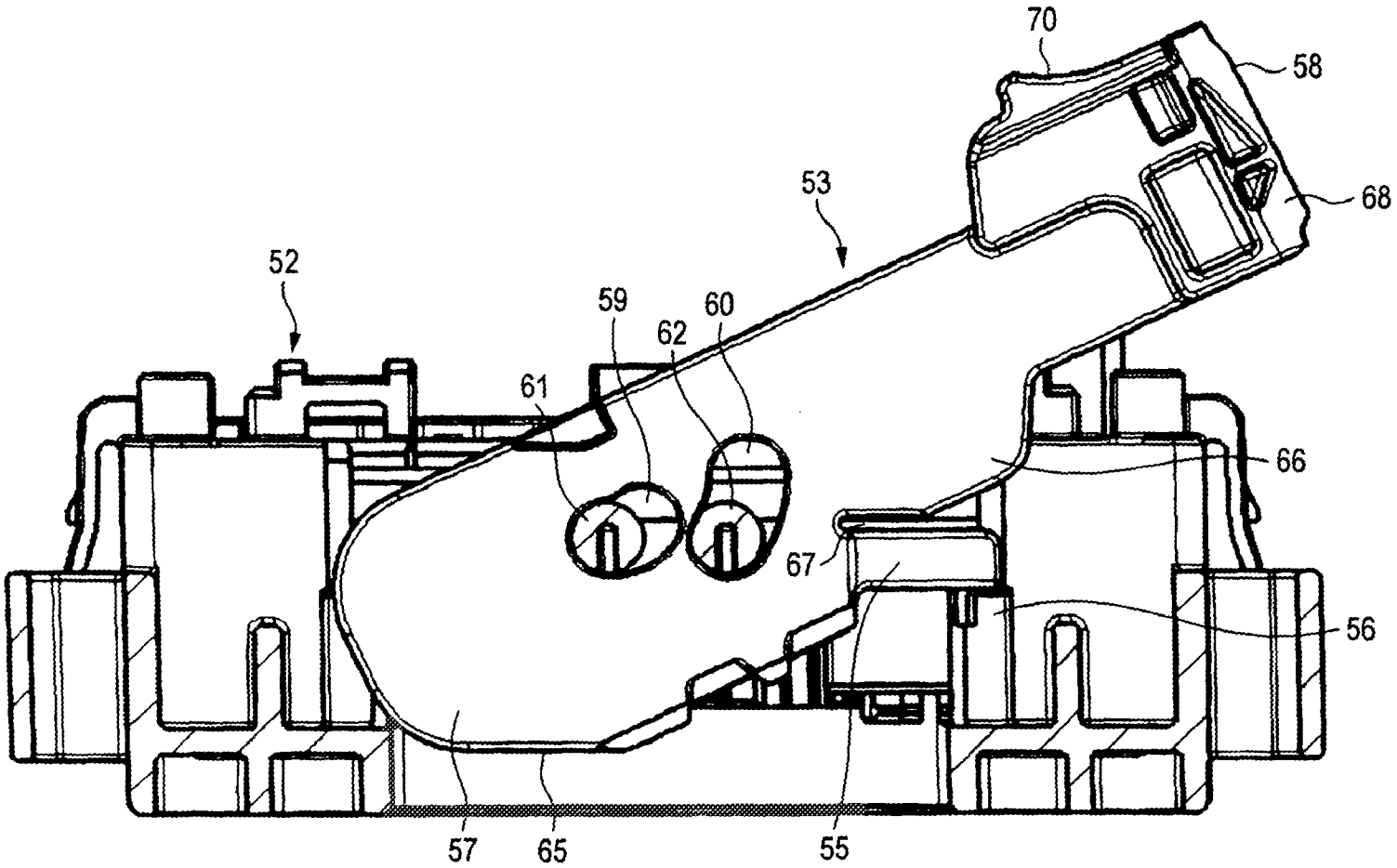
FIG. 3 is a view showing a condition in which the lever is held in a provisionally-retaining position relative to a male connector.

In FIGS. 1 to 3, the lever 53 is molded of a synthetic resin material, and includes a pair of lever side plates 57 each having the provisionally-retaining arm 55, and an interconnection operating portion 58 interconnecting the pair of lever side plates 57. The lever 53 is formed into a generally U-shape. The pair of lever side plates 57 are opposed to each other, and are spaced a predetermined distance from each other. Two pivot holes 59 and 60 are formed through an intermediate portion of each lever side plate 57. Two pivot shafts 61 and 62 of the male connector 52 are adapted to be inserted in the pivot holes 59 and 60, respectively. The lever 53 can be pivotally moved through these portions. Slide induction projections 63 are formed respectively on inner surfaces of the two lever side plates 57. Each slide induction projection 63 is disposed closer to a free end of the lever 53 than the pivot holes 59 and 60 are.

The provisionally-retaining arms 55 of a cantilever shape having elasticity are formed at the lever side plates 57, respectively. When the lever 53 is pivotally supported on the male connector 52, the provisionally-retaining arms 55 abut against the provisionally-retaining step portions 56 of the male connector 52, respectively. The provisionally-retaining arms 55 can hold the lever 53 in the provisionally-retaining position relative to the male connector 52. When each provisionally-retaining arm 55 is bent (elastically deformed) outwardly (outwardly from the outer surface of the lever side plate 57; forwardly from the sheet of FIG. 2) by a provisional retainment cancellation projection 64 of the female connector 54, the provisional retaining engagement of the provisionally-retaining arm 55 with the provisionally-retaining step portion 56 is canceled.

In FIG. 2, each provisionally-retaining arm 55 is disposed closer to the interconnection operating portion 58 than the pivot holes 59 and 60 are. The provisionally-retaining arm 55 projects (extends) from an edge 65 of the lever side plate 57. In this embodiment, the provisionally-retaining arm 55 has a strip-shape (This shape is merely one example), and includes a distal end 55*a*, one side edge (one side portion) 55*b*, and the other side edge (the other side portion) 55*c*. Reference numeral 55*d* denotes a proximal end of the provisionally-retaining arm 55.

Here, the edge 65 of each lever side plate 57 will be described. The edge 65 is the peripheral edge defining the outer shape or contour of the lever side plate 57. A bulge portion 66 is formed at a lower portion of the lever side plate 57, and is disposed closer to the interconnection operating portion 58 than the pivot holes 59 and 60 are. The provisionally-retaining arm 55 is disposed near to the edge of the bulge portion 66. Reference numeral 67 denotes a slit formed between the edge of the bulge portion 66 and the provisionally-retaining arm 55.

The edge of the bulge portion 66 includes a slit edge 65*a* defining one side edge of the slit 67, an edge 65*b* closer to the interconnection operating portion 58, and an arcuate edge 65*c* disposed between the slit edge 65*a* and the edge 65*b*. The slit edge 65*a* extends straight.

The provisionally-retaining arm 55 is formed such that the one side edge 55*b* thereof is disposed near to the straight slit edge 65*a* of the bulge portion 66 in parallel relation thereto. The distance between the one side edge 55*b* and the slit edge 65*a*, that is, the width L1 of the slit 67, is smaller than the amount of elastic deformation of the provisionally-retaining arm 55 beyond an elastic range thereof toward the slit edge 65*a*. An open end of the slit 67 has the small width L1.

When the provisionally-retaining arm 55 is elastically deformed or bent in a direction of arrow P, this arm 55 is brought into abutting engagement with the slit edge 65*a* before it is elastically deformed beyond the elastic range. In this embodiment, thus, the provisionally-retaining arm 55 can be slightly bent in the direction of the arrow P to be brought into abutting engagement with the slit edge 65*a*.

The provisionally-retaining arm 55 extends long beyond the point of intersection of the slit edge 65*a* with the arcuate edge 65*c* (This is merely one example). When the provisionally-retaining arm 55 is bent in the direction of arrow P, this retaining arm 55 is brought into abutting engagement with the slit edge 65*a* at this intersection point (This is merely one example). With this construction in which the provisionally-retaining arm 55 is adapted to abut against the slit edge 65*a* at the intersection point, the amount of elastic deformation (the angle of displacement) of the provisionally-retaining arm 55 will not change even when the length of the provisionally-retaining arm 55 is changed.

The interconnection operating portion 58 includes an interconnecting plate 68, a lock portion 69, and an operating portion 70.

In the above construction, the lever 53 is held in the provisionally-retaining position relative to the male connector 52 as shown in FIG. 3. Namely, the provisionally-retaining arms 55 of the lever 53 are held respectively against the provisionally-retaining step portions 56 of the male connector 52. FIG. 3 shows the condition before the male connector 52 is provisionally fitted to the female connector 54 (see FIG. 1).

In the condition in which the lever 53 is held in the provisionally-retaining position relative to the male connector 52, when an unnecessary force is applied to the interconnection operating portion 58 of the lever 53, this unnecessary force acts on the provisionally-retaining arms 55 held respectively against the provisionally-retaining step portions 56, so that the provisionally-retaining arms 55 are elastically deformed or bent as shown in FIGS. 4 and 5 (In FIG. 5, a broken line indicates the provisionally-retaining arm 55 which is not yet elastically deformed). Each provisionally-retaining arm 55 is slightly bent in the direction of arrow P, and is brought into abutting engagement with the slit edge 65*a*. The provisionally-retaining arm 55 is brought into abutting engagement with the slit edge 65*a* before it is elastically deformed beyond the elastic range, and therefore is prevented from being further bent.

As described above with reference to FIGS. 1 to 5, in the invention, damage or breakage of the provisionally-retaining arms 55 can be prevented. Therefore, the provisionally-retained condition of the lever 53 can be stabilized. In the invention, the bending (elastic deformation) of each provisionally-retaining arm 55 in an unintended direction can be suppressed. Breakage of the provisionally-retaining arms 55 is prevented, and therefore there is no need to repair the lever 53.

Figure 6:
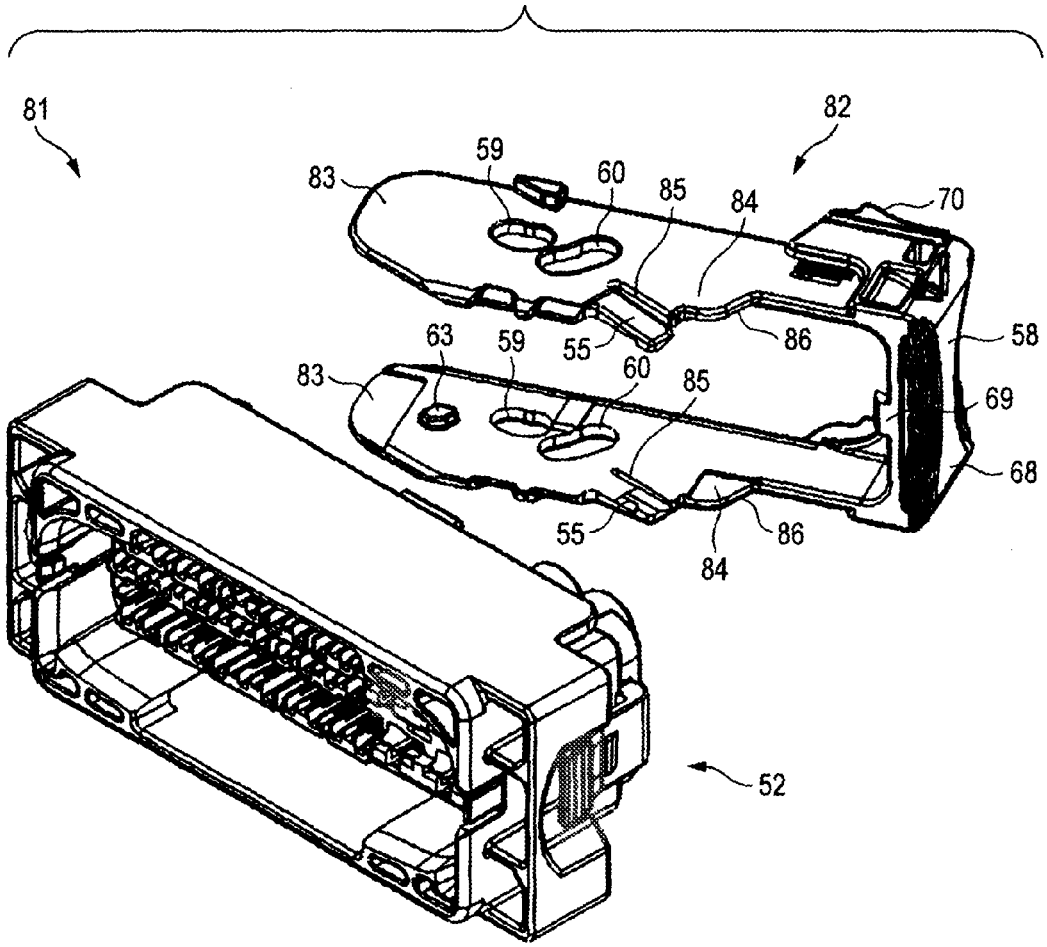
FIG. 6 is an exploded perspective view of another preferred embodiment of a lever-fitting connector of the invention.
Figure 7:
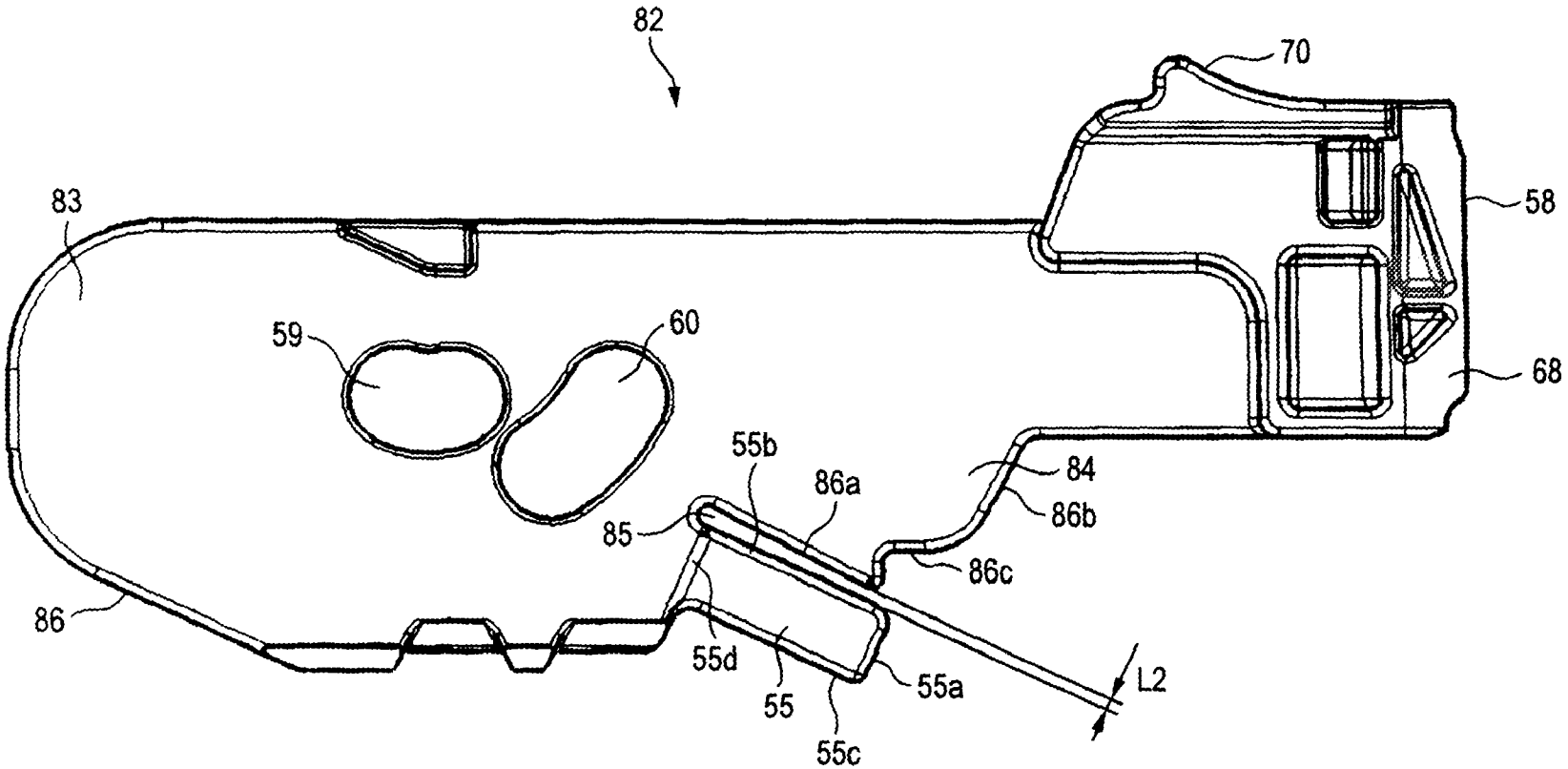
FIG. 7 is a side-elevational view of a lever.
Figure 8:
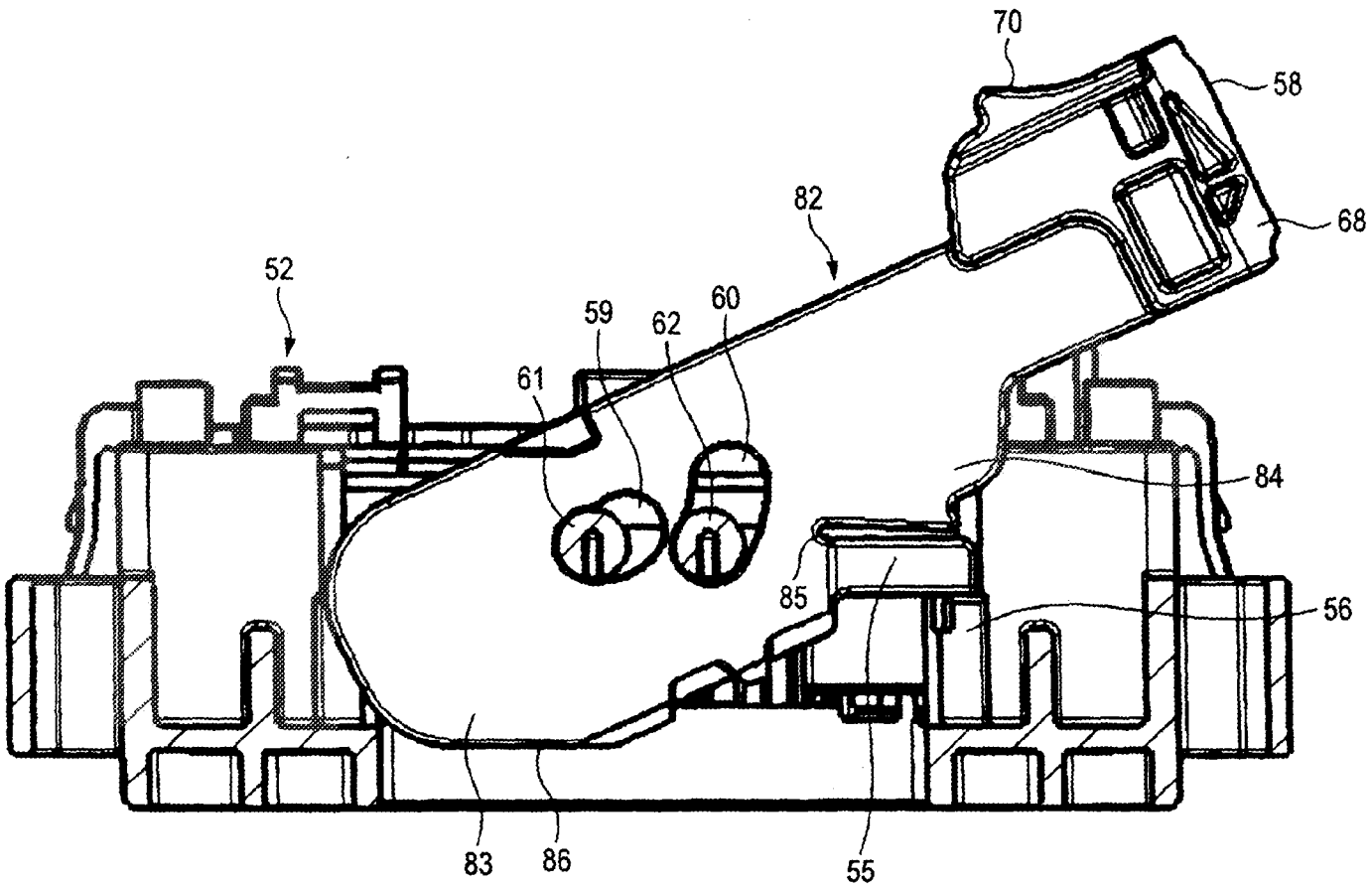
FIG. 8 is a view showing a condition in which the lever is held in a provisionally-retaining position relative to a male connector.
Figure 9:
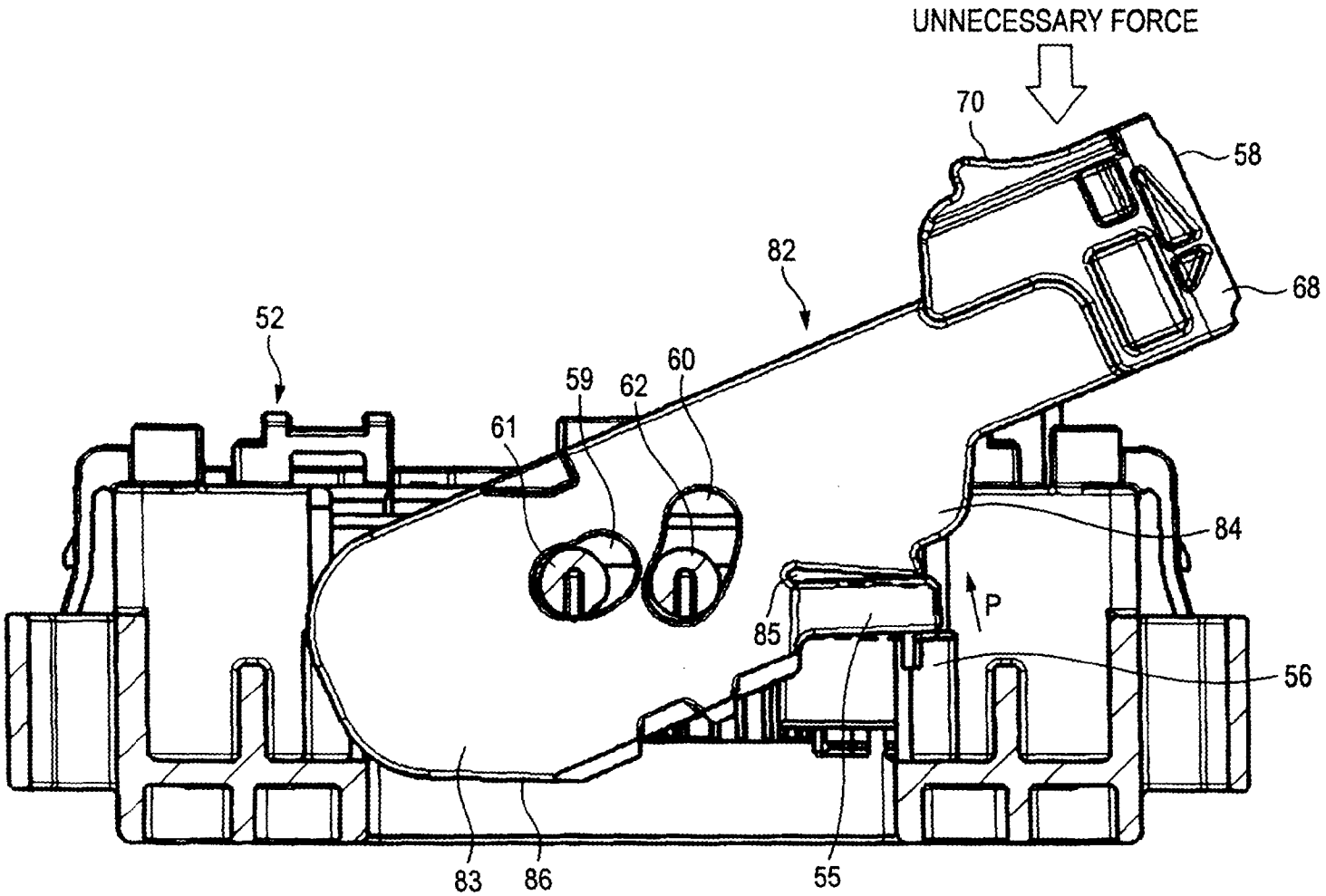
FIG. 9 is a view showing a condition in which a provisionally-retaining arm is elastically deformed.
Figure 10:
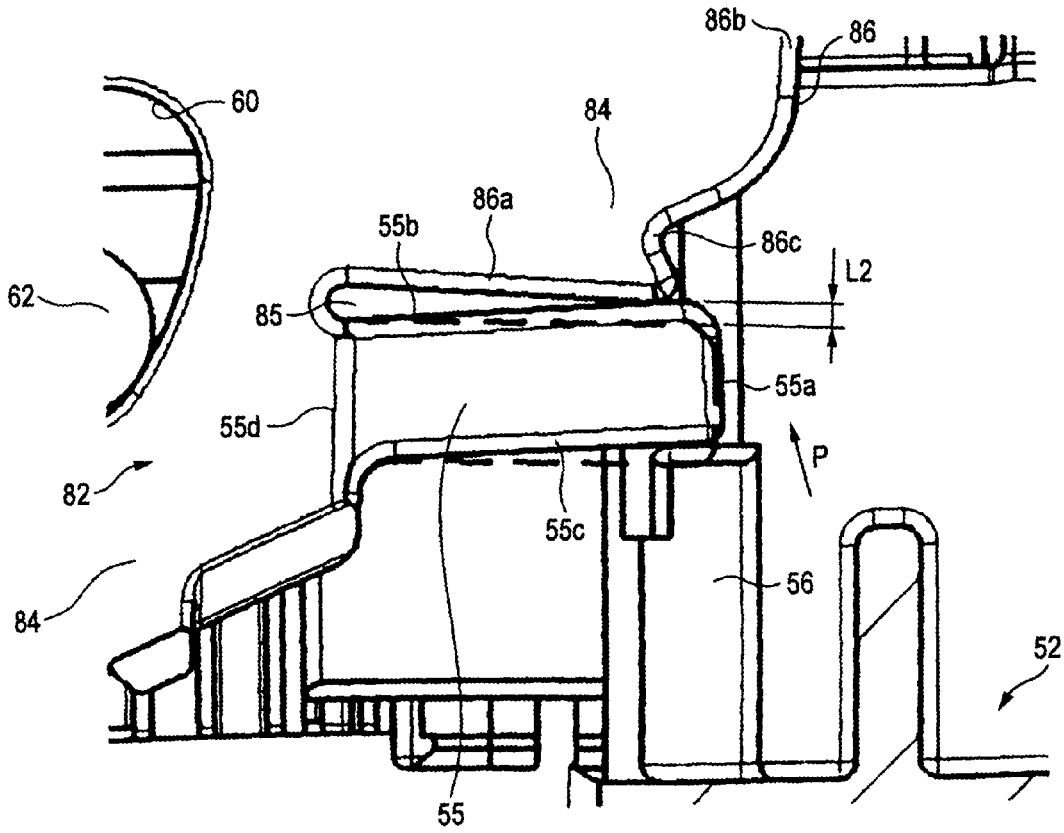
FIG. 10 is an enlarged view of an important portion of FIG. 9.
Figure 11A:
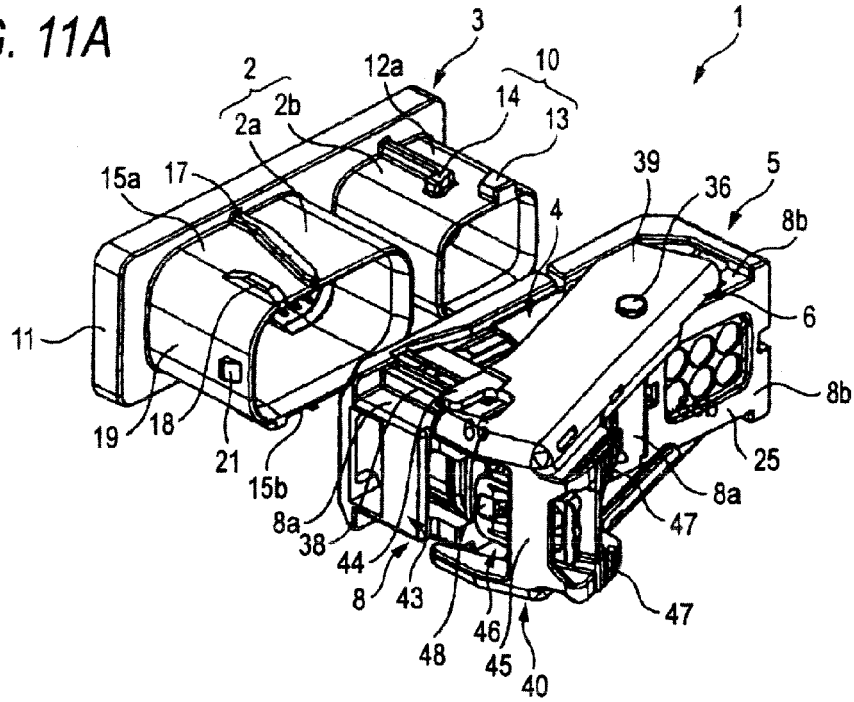
FIG. 11A Prior Art
FIG. 11A is a perspective view of a conventional lever-fitting connector.
Figure 11B:
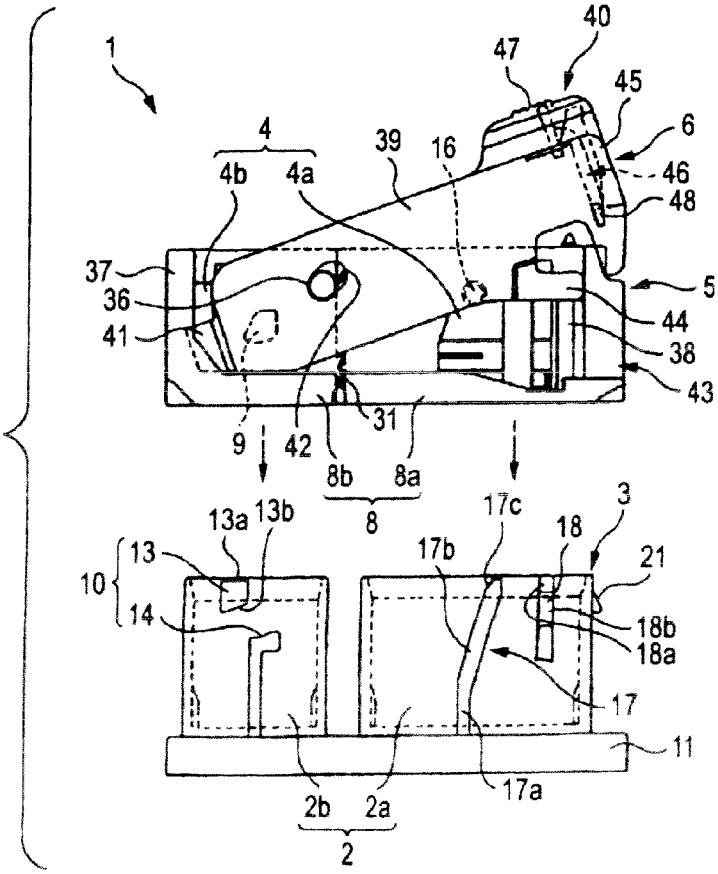
FIG. 11B Prior Art
FIG. 11B is a side-elevational view thereof.
Figure 12A:
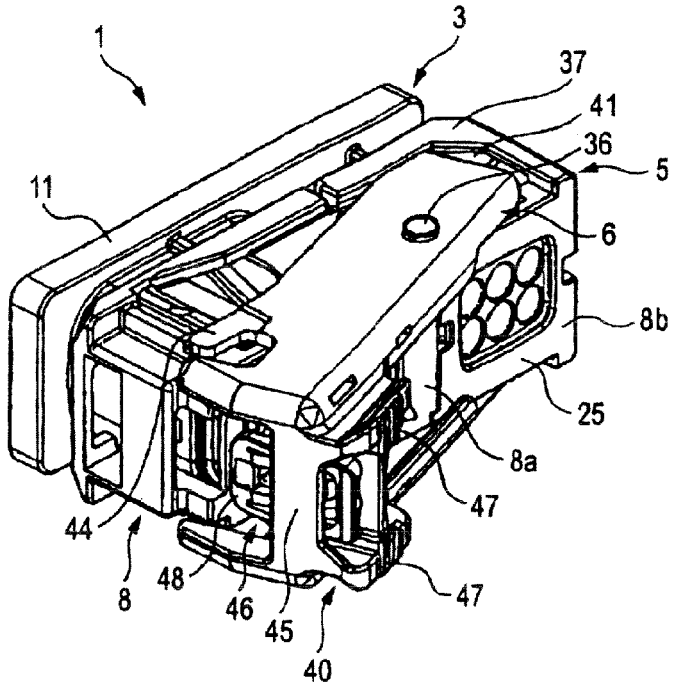
FIG. 12A Prior Art
FIG. 12A is a perspective view showing a condition in which a male connector and a female connector are fitted together in a provisionally-retaining position.
Figure 12B:
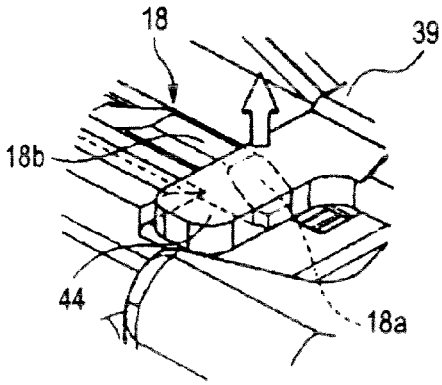
FIG. 12B Prior Art
FIG. 12B is an enlarged perspective view showing the relation between the provisionally-retaining arm and a provisional retainment cancellation projection.
Figure 12C:
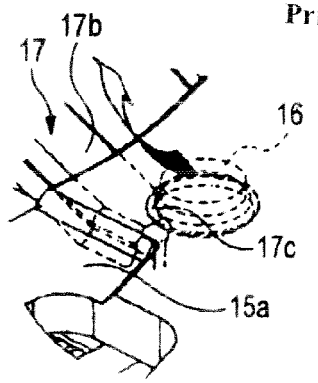
FIG. 12C Prior Art
FIG. 12C is an enlarged perspective view showing the relation between a slide induction projection and a lever sliding-purpose abutment projection.
Figure 13:
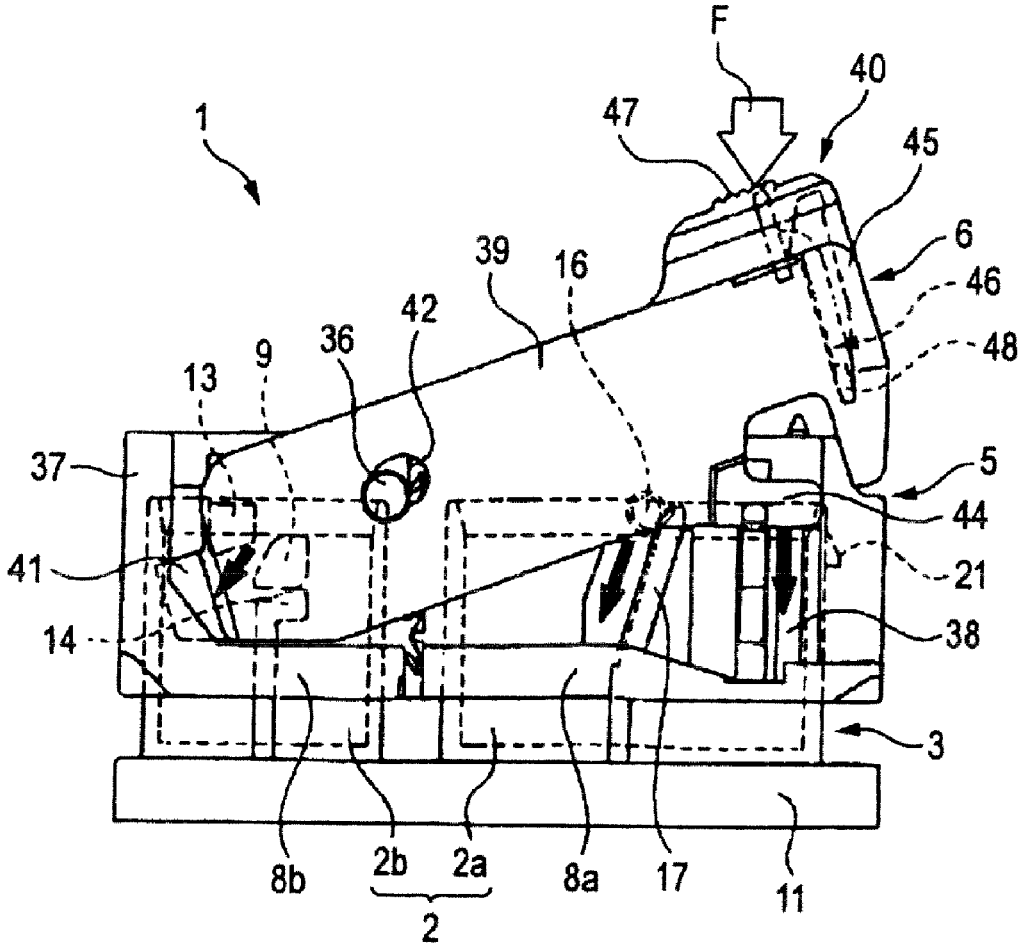
FIG. 13 Prior Art
FIG. 13 is a side-elevational view showing the condition in which the male connector and the female connector are fitted together in the provisionally-retaining position.
Figure 14:
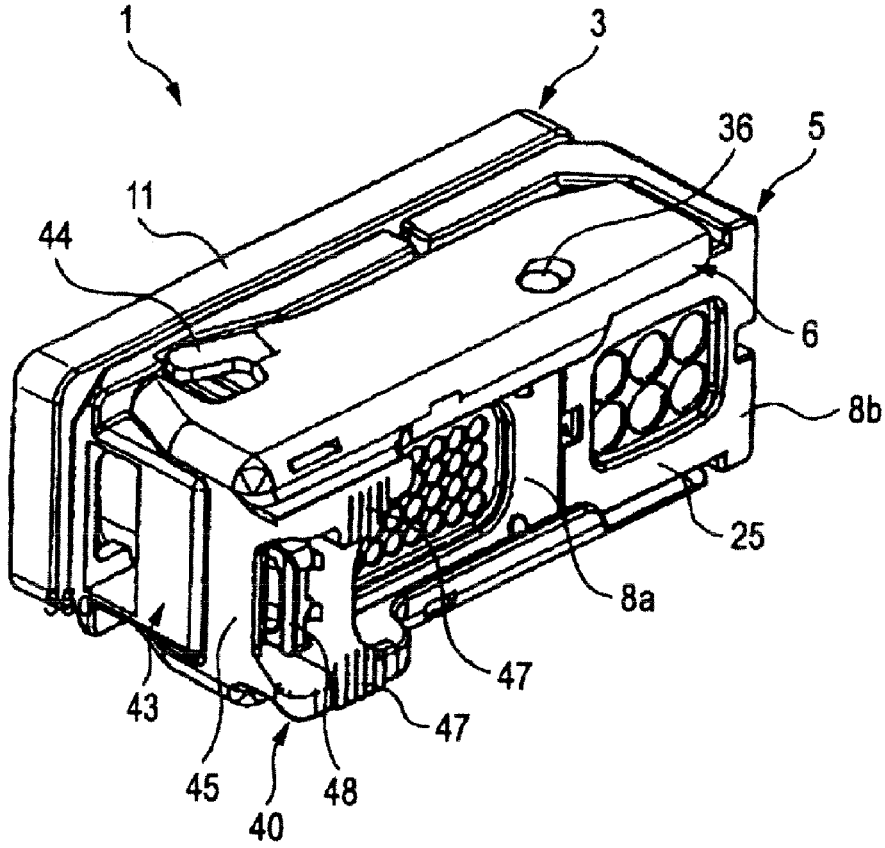
FIG. 14 Prior Art
FIG. 14 is a perspective view showing a condition in which the male connector and the female connector are completely fitted together.

Next, another preferred embodiment (second embodiment) of a lever-fitting connector of the invention will be described with reference to FIGS. 6 to 10. FIG. 6 is an exploded perspective view of the lever-fitting connector of this embodiment. FIG. 7 is a side-elevational view of a lever, FIG. 8 is a view showing a condition in which the lever is held in a provisionally-retaining position relative to a male connector, FIG. 9 is a view showing a condition in which a provisionally-retaining arm is elastically deformed, and FIG. 10 is an enlarged view of an important portion of FIG. 9. In this embodiment, those portions identical in construction to the corresponding portions of the above first embodiment will be designated by identical reference numerals, respectively, and description thereof will be omitted.

In FIG. 6, the lever-fitting connector 81 of the invention includes the male connector 52, the lever 82 pivotally mounted on the male connector 52, and a female connector 54 (see FIG. 1) which is fitted to the male connector 52 to be electrically connected thereto by pivotally moving the lever 82. The lever-fitting connector 81 has such a structure that when the pair of provisionally-retaining arms 55 formed at the lever 82 abut respectively against provisionally-retaining step portions 56 (see FIG. 8) of the male connector 52, the lever 82 is held in the provisionally-retaining position relative to the male connector 52.

The lever-fitting connector 81 differs from the lever-fitting connector of FIGS. 1 to 5 with respect to those portions of the lever 82 disposed near to the provisionally-retaining arms 55. More specifically, a bulge portion 84 of each of a pair of lever side plates 83 and a slit 85 formed between the bulge portion 84 and the provisionally-retaining arm 55 are different from those of the first embodiment.

An edge 86 of each lever side plate 83 is the peripheral edge defining the outer shape or contour of the lever side plate 83. The bulge portion 84 is formed at the lever side plate 83, and the provisionally-retaining arm 55 is disposed near to the edge of the bulge portion 84. The edge of the bulge portion 84 includes a slit edge 86*a* defining one side edge of the slit 85, an edge 86*b* closer to an interconnection operating portion 58, and a recessed edge 86*c* disposed between the slit edge 86*a* and the edge 86*b*.

In this embodiment, the slit edge 86*a* extends straight, but is not parallel to one side edge (one side portion) 55*b* of the provisionally-retaining arm 55 which defines the other side edge of the slit 85. Each slit 85 is formed such that its width is smaller at a distal end portion 55*a* of the provisionally-retaining arm 55 than at a proximal end 55*d* of the provisionally-retaining arm 55. In other words, the slit 85 is decreasing in width gradually from its inner end (closed end) toward its outer end (open end) as shown in FIG. 7. The width L2 of the sit 85 (that is, the width of the narrowest portion of the slit 85) is smaller than the width L1 of the slit of the above first embodiment. The width L2 of the slit 85 is much smaller than the amount of elastic deformation of the provisionally-retaining arm 55 beyond an elastic range thereof. The open end (outer end) of each slit 85 has the width L2 smaller than the width L1 of the first embodiment.

When the provisionally-retaining arm 55 is elastically deformed or bent in a direction of arrow P, this arm 55 is brought into abutting engagement with the slit edge 86*a* before it is elastically deformed beyond the elastic range. In this embodiment, thus, the provisionally-retaining arm 55 can be slightly bent in the direction of arrow P to be brought into abutting engagement with the slit edge 86*a*.

The provisionally-retaining arm 55 extends long slightly beyond the point of intersection of the slit edge 86*a* with the recessed edge 86*c* (This is merely one example). When the provisionally-retaining arm 55 is bent in the direction of arrow P, this retaining arm 55 is brought into abutting engagement with the slit edge 86*a* at this intersection point (This is merely one example).

In the above construction, the lever 82 is held in the provisionally-retaining position relative to the male connector 52 as shown in FIG. 8. Namely, the provisionally-retaining arms 55 of the lever 82 are held respectively against the provisionally-retaining step portions 56 of the male connector 52. FIG. 8 shows the condition before the male connector 52 is provisionally fitted to the female connector 54 (see FIG. 1).

In the condition in which the lever 82 is held in the provisionally-retaining position relative to the male connector 52, when an unnecessary force is applied to the interconnection operating portion 58 of the lever 82, this unnecessary force acts on the provisionally-retaining arms 55 held respectively against the provisionally-retaining step portions 56, so that the provisionally-retaining arms 55 are elastically deformed or bent as shown in FIGS. 9 and 10 (In FIG. 10, a broken line indicates the provisionally-retaining arm 55 which is not yet elastically deformed). Each provisionally-retaining arm 55 is slightly bent in the direction of arrow P, and is brought into abutting engagement with the slit edge 86*a*. The provisionally-retaining arm 55 is brought into abutting engagement with the slit edge 86*a* before it is elastically deformed beyond the elastic range, and therefore is prevented from being further bent.

As described above with reference to FIGS. 6 to 10, in the invention, damage or breakage of the provisionally-retaining arms 55 can be prevented. Therefore, the provisionally-retained condition of the lever 82 can be stabilized. In the invention, the bending (elastic deformation) of each provisionally-retaining arm 55 in an unintended direction can be suppressed. Breakage of the provisionally-retaining arms 55 is prevented, and therefore there is no need to repair the lever 82.

In this embodiment, the slit 85 is decreasing in width gradually from its inner end (closed end) toward its outer end (open end) as shown in FIG. 7. However, the shape of the slit 85 is not limited to this, and may be modified so that a breakage or a damage of the provisionally-retaining arms 55 can be prevented. For example, the slit 85 may be formed in such a manner that the one side edge 55*b* is not straight, but is curved or has a step, etc. to have the width smaller at a distal end portion 55*a* of the provisionally-retaining arm 55 than at a proximal end 55*d* of the provisionally-retaining arm 55.

The present invention is not limited to the above embodiments, and various modifications can be made without departing from the subject matter of the invention.

Figure 15:
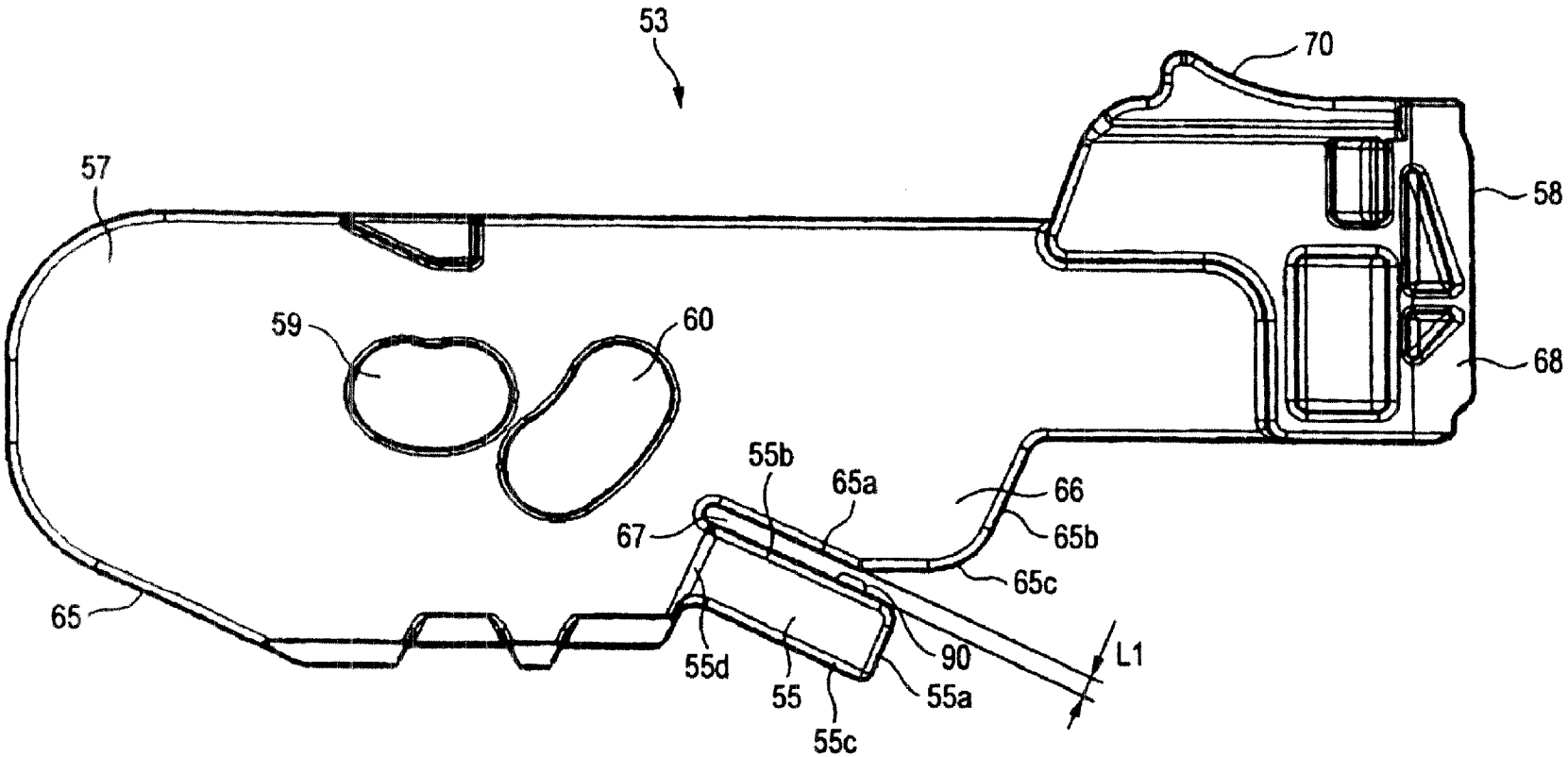
FIG. 15 Prior Art
FIG. 15 is a side-elevational view of a lever.

For example, in the case of the provisionally-retaining arm 55 and the slit edge 65*a* shown in FIG. 2, an abutment convex portion 90 (projection) may be formed on and project from the provisionally-retaining arm 55 toward the slit edge 65*a* so that the provisionally-retaining arm 55 can be more quickly brought into abutting engagement with the slit edge 65*a* through the abutment convex portion as shown in FIG. 15. Alternatively, an abutment convex portion (projection) may be formed on and project from the slit edge 65*a* toward the provisionally-retaining arm 55 so that the provisionally-retaining arm 55 can be more quickly brought into abutting engagement with the slit edge 65*a* through the abutment convex portion. By providing the abutment convex portion (projection), the amount of elastic deformation of the provisionally-retaining arm 55 in an unintended direction can be further reduced.

What is claimed is:

1. A lever-fitting connector, comprising:

a first connector having a provisionally-retaining cancellation portion;

a second connector having a provisionally-retaining portion; and a rotatable lever which engages the first connector with the second connector, wherein the rotatable lever includes a provisionally-retaining arm for provisionally retaining the lever with the second connector to abut on the provisionally-retaining portion;

wherein the provisionally-retaining arm extends to form a slit between the provisionally-retaining arm and an edge of the rotatable lever;

wherein a width of the slit is smaller than an elastic range of the provisionally-retaining arm at which the provisionally-retaining arm bends toward the edge; and wherein the abutment of the provisionally-retaining arm on the provisionally-retaining portion is cancelled when the provisionally-retaining arm is bent outwardly by the provisionally-retaining cancellation portion, thereby allowing the rotatable lever to be rotated.

2. The lever-fitting connector according to claim 1, wherein a width of the slit between the edge of the rotatable lever and a head of the retaining arm is smaller than a width of the slit between the edge of the rotatable lever and a root of the retaining arm.

3. The lever-fitting connector according to claim 1, wherein a convex portion is formed on at least one of the retaining arm and the edge of the rotatable lever to narrow the width of the slit.

* * * * *